US009375944B2

(12) United States Patent
Yamamoto

(10) Patent No.: US 9,375,944 B2
(45) Date of Patent: Jun. 28, 2016

(54) LASER ERASING APPARATUS AND LASER ERASING METHOD

(75) Inventor: Kazutaka Yamamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 1087 days.

(21) Appl. No.: 13/504,088

(22) PCT Filed: Sep. 1, 2011

(86) PCT No.: PCT/JP2011/070415

§ 371 (c)(1),
(2), (4) Date: Apr. 25, 2012

(87) PCT Pub. No.: WO2012/033146

PCT Pub. Date: Mar. 15, 2012

(65) Prior Publication Data

US 2012/0211673 A1 Aug. 23, 2012

(30) Foreign Application Priority Data

Sep. 10, 2010 (JP) ..... 2010-203707

(51) Int. Cl.
*B41M 7/00* (2006.01)
*B41J 2/32* (2006.01)
(Continued)

(52) U.S. Cl.
CPC .. *B41J 2/32* (2013.01); *B41J 2/473* (2013.01); *B41J 2/4753* (2013.01); *B41J 2202/37* (2013.01); *B41M 5/305* (2013.01)

(58) Field of Classification Search
CPC . B41F 6/0006; B41M 5/0041; B41M 5/0076; B41M 5/0082; B41M 5/0094; B41M 5/00; B41M 5/0058; B41M 5/007; B41J 2/32; B41J 2/325; B41J 2/315; B41J 2/33
USPC ..... 347/179, 171; 399/167, 328; 503/201
See application file for complete search history.

(56) References Cited

U.S. PATENT DOCUMENTS 7,439,993 B2 10/2008 Ishimi et al.
2007/0036039 A1 2/2007 Kawahara et al.
(Continued)

FOREIGN PATENT DOCUMENTS

CN 101676121 A 3/2010
EP 1 752 298 2/2007
(Continued)

OTHER PUBLICATIONS

Combined Chinese Office Action and Search Report issued Feb. 25, 2014 in Patent Application No. 201180004452.1 (with English language translation).
(Continued)

*Primary Examiner* — Kristal Feggins
(74) *Attorney, Agent, or Firm* — Oblon, McClelland, Maier & Neustadt, L.L.P

(57) ABSTRACT

A laser erasing apparatus includes a conveyance unit to move a reversible thermal recording medium having display information thereon at a predetermined moving speed, the reversible thermal recording medium reversibly changing a color tone thereof depending on a temperature; and a laser erasing unit configured to erase the display information by irradiating the reversible thermal recording medium with a laser beam while the reversible thermal recording medium is moving and by deflecting the laser beam at a predetermined scanning speed lower than the predetermined moving speed in a same direction as a moving direction of the reversible thermal recording medium.

20 Claims, 7 Drawing Sheets

(51) Int. Cl.

| | |
|---|---|
| ***B41J 2/47*** | (2006.01) |
| ***B41J 2/475*** | (2006.01) |
| *B41M 5/30* | (2006.01) |

(56) References Cited

U.S. PATENT DOCUMENTS

| | | | | |
|---|---|---|---|---|
| 2010/0061198 | A1 | 3/2010 | Kawahara et al. | |
| 2010/0069238 | A1* | 3/2010 | Asai | B41J 2/4753 503/201 |
| 2011/0090296 | A1 | 4/2011 | Ishimi et al. | |

FOREIGN PATENT DOCUMENTS

| | | |
|---|---|---|
| JP | 2001 088333 | 4/2001 |
| JP | 2001 121730 | 5/2001 |
| JP | 2002 113889 | 4/2002 |
| JP | 2006 231647 | 9/2006 |
| JP | 2007 076122 | 3/2007 |
| JP | 2007 316536 | 12/2007 |
| JP | 2008-137243 | 6/2008 |
| JP | 2008 213440 | 9/2008 |
| JP | 2009 096011 | 5/2009 |
| JP | 2011 104995 | 6/2011 |
| JP | 2011 116116 | 6/2011 |

OTHER PUBLICATIONS

The Extended European Search Report issued Mar. 14, 2014, in Application No./Patent No. 11823620.7—1701/2613945 PCT/JP2011070415.

International Search Report issued on Nov. 1, 2011 in PCT/JP11/70415 filed on Sep. 1, 2011.

* cited by examiner

LASER ERASING APPARATUS AND LASER ERASING METHOD

TECHNICAL FIELD

The present invention generally relates to laser erasing apparatuses and laser erasing methods. More specifically, the present invention relates to a laser erasing apparatus and a laser erasing method that irradiate a reversible thermal recording medium that reversibly changes its color tone depending on a temperature with a laser beam and erase display information on the reversible thermal recording medium.

BACKGROUND ART

Conventionally, in terms of resource saving and environmental protection, a recording information updating apparatus and a recording information updating method are known in which a reversible thermal recording medium where a color appears and disappears by heat is applied to a shipping container label of a conveyor-style logistic system, as disclosed in Japanese Patent Application Publication No. 2006-231647 (which is hereinafter called Patent Document 1).

In the recording information updating apparatus and the recording information updating method disclosed in Patent Document 1, writing is performed by pushing a thermal head onto the label. However, because it is difficult to fix the thermal head to the reversible thermal recording medium, a lot of devices and methods have been developed that perform non-contact recording and erasing by using a laser, as disclosed in Japanese Patent Application Publication No. 2007-76122 (which is hereinafter called Patent Document 2) and Japanese Patent Application Publication No. 2001-88333 (which is hereinafter called Patent Document 3).

Patent Document 2 discloses a recording information updating apparatus where a single laser apparatus performs recording and erasure by deflecting a laser and by scanning a stopping reversible thermal recording medium by the laser. Also, Patent Document 3 discloses a record erasing apparatus that performs recording and erasure by scanning a reversible thermal recording medium by moving the reversible thermal recording medium with respect to a static laser.

In this way, by using the laser, the recording and erasing can be performed onto the reversible thermal recording medium without contact, and the reversible thermal recording medium can be used as the shipping container label of the conveyor-style logistic system.

However, such as a configuration disclosed in Patent Document 2, in the record information updating apparatus where the single laser apparatus performs both of the recording and erasure by deflecting the laser for scanning, a problem of a takt time being longer has been caused. Here, the "takt time" means a time needed to assemble or to process a product in a certain assembly station or a process station in a manufacturing line, or a total time to produce a product in a manufacturing line. The takt time may be roughly called a "cycle time". The takt time may aim to set the production rate so as to meet customer's demand, or may aim to indicate productivity or throughput.

Moreover, even if two laser apparatuses are provided, and erasing and recording are performed by the respective laser apparatuses, because erasing needs more energy than recording, a problem of an erasing time being delayed compared to a recording time has occurred.

Furthermore, even if the method of the reversible thermal recording medium being stopped and scanning being performed by deflecting the laser is adopted, since moving and stopping the shipping container takes time, a problem of a time allotted for erasing in a takt time being short has occurred.

In addition, such as a configuration disclosed in Patent Document 3, in the record erasing apparatus that performs scanning by fixing the laser and by moving the reversible thermal recording medium, if the reversible thermal recording medium has a small width relative to the shipping container width, a problem of a time allotted for erasing in the takt time being short has occurred.

DISCLOSURE OF INVENTION

Accordingly, embodiments of the present invention may provide a laser erasing apparatus and a laser erasing method solving one or more of the problems discussed above.

More specifically, the embodiments of the present invention may provide a laser erasing apparatus and a laser erasing method that can perform recording and erasure onto a reversible thermal recording medium in a short takt time by using a laser without contact despite having a simple configuration.

According to one aspect of the present invention, there is provided a laser erasing apparatus including:

a conveyance unit to move a reversible thermal recording medium having display information thereon at a predetermined moving speed, the reversible thermal recording medium reversibly changing a color tone thereof depending on a temperature; and a laser erasing unit configured to erase the display information by irradiating the reversible thermal recording medium with a laser beam while the reversible thermal recording medium is moving and by deflecting the laser beam at a predetermined scanning speed lower than the predetermined moving speed in a same direction as a moving direction of the reversible thermal recording medium.

According to another aspect of the present invention, there is provided a laser erasing method including the steps of:

moving a reversible thermal recording medium having display information thereon at a predetermined speed, the reversible thermal recording medium reversibly changing a color tone thereof depending on a temperature; and erasing the display information by irradiating the reversible thermal recording medium with a laser beam while the reversible thermal recording medium is moving at the predetermined moving speed and by deflecting the laser beam at a predetermined scanning speed lower than the predetermined moving speed in a same direction as a moving direction of the reversible thermal recording medium.

DESCRIPTION OF EMBODIMENTS

A description is given, with reference to the accompanying drawings, of embodiments of the present invention.

Figure 1:
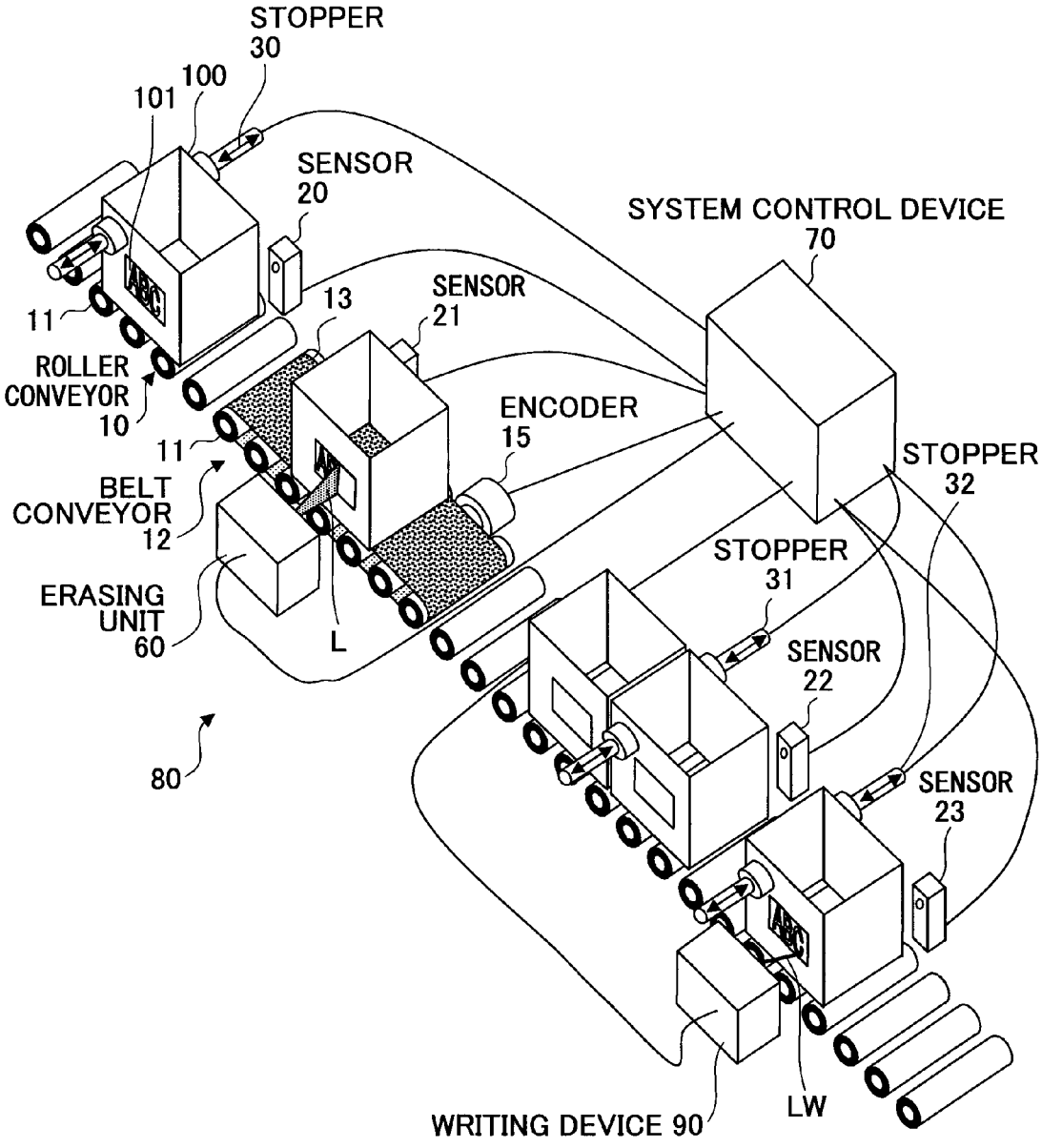
FIG. 1 is a diagram showing a whole configuration of an example of a conveyor system using a laser erasing apparatus of an embodiment of the present invention.

FIG. 1 is a diagram showing a whole configuration of an example of a conveyor system using a laser erasing apparatus of an embodiment of the present invention. In FIG. 1, the conveyor system of the present embodiment includes a roller conveyor 10, a belt conveyor 12, an encoder 15, sensors 20 to 22, stoppers 30 to 32, a laser erasing unit 60, a system control device 70, and a laser writing device 90. Here, the laser erasing unit 60 and system control device 70 constitute a laser erasing apparatus 80 of the present embodiment.

Moreover, in FIG. 1, containers 100 to be conveyed are shown as related components. A rewritable label 101 to be erased by the laser erasing apparatus 80 of the present embodiment is stuck on the side surface of the containers 100. The rewritable labels 101 are made of a reversible thermal recording medium printable and erasable by heating and are formed to be able to erase already drawn display information and to print further. Here, in FIG. 1, information of letters of "ABC" is printed on the rewritable label 101.

The roller conveyor 10 and the belt conveyor are conveyance units to move and convey the container 100. The roller conveyor 10 is configured in a line as a whole by arranging plural rollers 11 in parallel at a predetermined interval and by making a line in a roller rotation direction. The roller conveyor 10 allows the container 100 to move fast by rotating the respective rollers 11 fast. Moreover, it is possible to adjust a stop and a speed of the rollers 11 in a short unit and to control motion of the containers 100 on the line individually. The roller conveyors 10 are used in places other than where the laser erasing unit 60 is disposed.

On the other hand, the belt conveyor 12 includes a belt 13 provided so as to wind around the plural rollers 11. The belt conveyor 12 cannot rotate faster than the roller conveyor 10 because the belt 13 is wound around the belt conveyor 12, but the belt conveyor 12 can move all of the containers 100 at a constant speed, keeping all the containers 100 stable because a friction force between the belt 13 and the container 100 is high. If erasing the display information on the surface of the rewritable label 101 is performed by the laser erasing unit 60, it is necessary to move the rewritable label 101 at a stable constant speed in order to irradiate the rewritable label 101 with a laser beam L. Accordingly, the belt conveyor 12 is provided at a position corresponding to the laser erasing unit 60.

The encoder 15 is a speed detection unit to detect a moving speed of the container 100, that is, the rewritable label 101. If the belt conveyor 12 is used, the moving speed of the container 100 is stable and the container 100 moves at a speed approximately proportional to the rotation speed of the rollers 11. Accordingly, if the rotation speed of the rollers 11 can be detected by the encoder 15, the moving speed of the rewritable label 101 can be also detected.

The sensors 20 to 22 are detection units to detect the presence of the container 100. For example, the sensors 20 to 22 may be configured to detect the container 100 being in front of the sensors 20 to 22 if the sensors 20 to 22 emit light and detect the reflected light.

The stoppers 30 to 32 are unit to stop the container 100 at a predetermined position. If the sensors 20 to 22 detect the presence of the container 100, the stoppers 30 to 32 can stabilize and stop the container 100 by sandwiching the container 100 between themselves. Here, the stoppers 30 to 32 can be configured in various ways. For example, it is possible to configure the stoppers 30 to 32 in a way where plate-like stoppers 30 to 32 project upward from between the rollers 11 and stop the container 100.

The laser erasing unit 60 is a unit to emit the laser onto the rewritable label 101 and to erase already written information without contact. Hence, the laser erasing unit 60 includes a laser optical system including a laser light source and the like. A laser beam L emitted from the laser erasing unit 60 has a vertically long shape as shown in FIG. 1, and is formed to be vertically longer than the display information on the rewritable label 101. The laser erasing unit 60 is disposed beside the belt conveyor 12, and performs erasure while the container 100 is moving at a constant speed. Here, the laser erasing unit 60 is driven and controlled by the system control device 70. Therefore, the laser erasing unit including the laser light source and a part that controls the laser erasing unit 60 of the system control device 70 constitute the whole of the laser erasing apparatus of the present embodiment.

The system control device 70 is a device to control a whole conveyor system, and connected to respective devices and parts. The respective devices and parts operate by instructions of the system control device 70. The laser erasing unit 60 is controlled by the system control device 70.

The laser writing device 90 is a device to irradiate the rewritable label 101 with a laser beam LW and to perform printing without contact. The laser beam LW of the laser writing device 90 has a round beam shape with which can irradiate the rewritable label 101 as a spot, different from that of the laser erasing unit 60, in order to draw letters and the like with a single stroke. The laser writing device 90 is disposed beside the roller conveyor 10 and carries out printing while the container 100 is stopping.

Next, an explanation is given about an operation of the conveyor system of the present embodiment. The containers 100 flow from the upper left toward the lower right in FIG. 1. The container 100 brought in the upper left of the conveyor line (which means the roller conveyor 10) are stopped temporarily short of the belt conveyor 12 by the sensor 20 and stopper 30. Then, when the forward container 100 passes through the sensor 21, the stopper 20 is released and the container 100 moves onto the belt conveyor 12. This is a temporary stop to adjust intervals and the like of the containers 100 that flow on the belt conveyor 12, and to make sure that the laser erasing unit 60 can operate. The container 100 on the belt 13 passes in front of the laser erasing unit 60 at a predetermined speed. The system control device 70 detects that the container 100 to be erased arrives at a predetermined position by the sensor 21, and outputs an erasing start signal to the laser erasing unit 60. The laser erasing unit 60 receives the erasing start signal from the system control device 70, and deflects the laser L in the same direction as the container 100 moving direction at a predetermined speed and for a predetermined time, emitting the laser beam L onto the rewritable label 101 at a predetermined power. Due to the laser beam L deflecting motion, the already printed information is erased.

The container 100 having the rewritable label 101 whose display information has been erased moves to the following roller conveyor 10, and is stopped short of the laser writing device 90 by the sensor 22 and stopper 31. This is intended to prevent the following container 100 from hitting the container 100 in printing and the printing from being disarranged. When the forward container 100 whose printing has been finished moves, the stopper 31 is released and the following container 100 moves in front of the laser writing device 90. If the sensor detects that the container 100 to be printed arrives at a predetermined position, the system control device 70 stabilizes the container 100 by closing the stopper 32, and outputs a print start signal to the laser writing device 90. The laser writing device 90 receives data of printing contents and the print start signal, and prints the information by the laser. After finishing printing, the laser writing device 90 output a print finish signal to the system control device 70. The system control device 70 that has received the print finish signal releases the stopper 32 and moves the container 100 to the next process.

Figure 2:
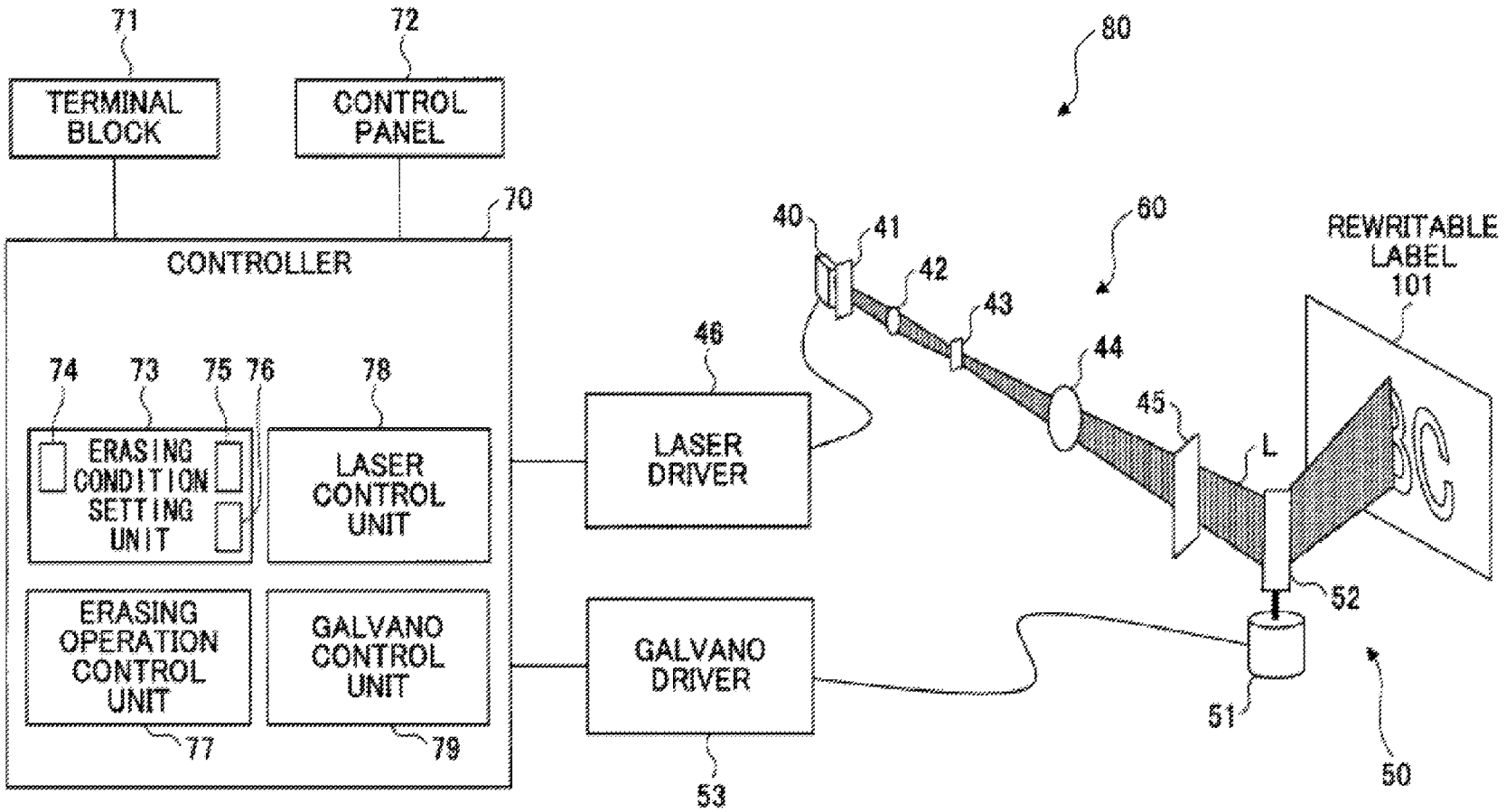
FIG. 2 is a configuration diagram showing an example of the laser erasing apparatus of the embodiment of the present invention.

FIG. 2 is a configuration diagram showing an example of a laser erasing apparatus 80 of an embodiment of the present invention. The laser erasing apparatus 80 of the present invention is composed of a laser erasing unit 60 and a system control device 70, divided roughly. The laser erasing unit 60 includes a laser light source 40, a first cylindrical lens 41, a first spherical lens 42, a microlens array 43, a second spherical lens 44, a second cylindrical lens 45, a laser driver 46, a galvano mirror 50 and galvano driver 53. On the other hand, the system control device 70 includes a terminal block 71, a control panel 72, an erasing condition setting unit 73, an erasing operation control unit 77, a laser control unit 78 and a galvano control unit 79. Furthermore, the erasing condition setting unit 73 includes a laser power setting unit 75 and a scan speed setting unit 76. Moreover, the rewritable label 101 is also shown as an irradiation target. Here, a rewritable label 101 is made of a reversible thermal recording medium as described in FIG. 1.

The laser light source 40 is a unit to emit a laser beam L. The vertical length of a beam shape of the laser light source 40 of the present embodiment is needed to be longer than that of the information displayed on the rewritable label 101. This allows the information of the rewritable label 101 to be erased by only deflecting the laser beam L in a horizontal direction, and the rewritable label 101 can be erased by a single scanning.

As long as the laser light source 40 has a vertically longer shape than the information on the rewritable label 101 as mentioned above, various kinds of laser light sources 40 are available. For example, a laser diode array where laser diodes are vertically arranged may be used. The laser diode array is a module that includes plural laser diode light sources being arranged. For example, a laser diode array including seventeen laser diode light sources may be used. In this case, the length of the light sources from the first to the seventeenth may be, for example, 10 mm. The laser beams L emitted from the laser light source 40 of the laser diode array are enlarged by plural lenses 40 to 45, and an energy density of the laser beams L is made uniform, and a linear beam of 60 mm in length and 0.5 mm in width is formed on the rewritable label 101.

Next, descriptions are given about roles of the respective lenses 41 to 45. The first cylindrical lens 41 is a beam shaping lens to narrow the width of the laser beams L emitted from the laser light source 40. The first spherical lens 42 is a lens that vertically shortens the laser beams L once. The microlens array 43 is a lens to overlap the adjacent laser beams L, with regard to the vertically arranged seventeen points emitted from the laser diode array, and to form the vertically long beam shape as a whole. The second spherical lens 44 is a height adjustment lens to adjust the height of the laser beam L to the rewritable label 101. The second cylindrical lens 45 is a lens to narrow the width of the laser beam L and to shape the laser beam L at the end.

The laser driver 46 is a circuit that generates a drive current of the laser light source 40. The laser driver 46 controls the laser power according to an instruction value from the system control device 70.

The optical system composed of such a laser light source 40, lenses 41 to 45, and the laser driver 46 can generate the linear laser beam L.

The galvano mirror 50 is a deflection unit that includes a galvano meter 51 equipped with a mirror 52 that reflects the laser beam L. The galvano mirror 50 can deflect the laser beam L for scanning. The galvano driver 53 is a circuit that controls an angle of the mirror 52 according to the system control device 70. More specifically, the galvano driver 53 compares an angle sensor signal and the instruction value from the system control device 70, and provides a drive signal for the galvano mirror 50 so as to minimize the error.

Next, a description is given about the system control device 70. The terminal block 71 is a unit to electrically connect the respective devices and units of the conveyor system described in FIG. 1 with the system control device 70. The terminal block 71 includes an input signal terminal for an erasing start signal, an interlock signal, an environmental temperature signal and an encoder signal, and an output signal terminal for an erasing preparation completion signal, an erasing active signal and a malfunction occurrence signal. Here, the erasing start signal is a signal to make the laser erasing unit 60 start erasing action; the interlock signal is a signal to bring the erasing action to an emergency stop; and the environmental temperature signal is a signal to correct the laser power under the environmental temperature. Also, the encoder signal is a signal to detect a motion speed of the rewritable label 101; the erasing preparation completion signal is a signal to indicate that the erasing start signal is receivable; and the erasing active signal is a signal to indicate that erasing is being performed. Furthermore, the malfunction occurrence signal is a signal to indicate that the system control device 70 has discovered a malfunction such as a laser malfunction, a galvano mirror malfunction and the like.

The control panel 72 is a user interface by simple displays and switches, which is possible to choose a menu and input values.

The erasing condition setting unit 73 is a unit to control the control panel 72 and to set various erasing conditions based on the information input into the control panel 72. The erasing condition setting unit 73 sets, for example, a scanning width of the laser beam L specified by a user, a scanning speed of the laser beam L, a scanning direction of the laser beam L, a laser output power, an erasing start delay time, a container moving speed and the like. In addition, the erasing condition setting unit 73 includes a nonvolatile memory to store the set erasing conditions.

The erasing condition setting unit 73 includes a laser power setting unit 75 and a scan speed setting unit 76. The laser power setting unit 75 is a unit to set a laser power of the laser beam L output from the laser light source 40. The laser power may be set based on the values input from the control panel 72. If the laser power is directly input into the control panel 72, the laser power may be set according to the input. On the other hand, if the laser power is not input, an appropriate laser power is calculated and set based on the values of the input items.

Moreover, if an actual moving speed of the rewritable label 101 is input while the rewritable label 101 is moving from an erasing operation control unit 77, as described hereinafter, the laser power setting unit 75 corrects the set laser power and sets the laser power again based on the actual moving speed while moving. However, a function of performing this operation is not always necessary, but may be provided if desired.

The scan speed setting unit 76 is a unit to set a scanning speed of the laser beam L. In the laser erasing apparatus 80 of the present embodiment, the scan speed setting unit 76 sets the scanning speed of the laser beam L at a slower speed than the moving speed of the rewritable label 101. Hence, if a container moving speed or a rewritable label moving speed is input from the control panel 72, the scanning speed of the laser beam L is set at a slower speed than the input moving speed. Meanwhile, if there is no specific input, the scan speed setting unit 76 refers to the container moving speed or the rewritable moving speed set and stored in the erasing condition setting unit 73, and sets a slower scanning speed than the moving speed.

The scanning speed may be set based on a rule such as a certain arithmetic processing formula. For example, if the scanning speed is determined to be a half of the moving speed of the container 100 or the rewritable label 101, the scanning speed is set by following the rule. The rule such as an arithmetic processing formula may be arbitrarily decided according to intended purpose. For example, the rule may be expressed by a simple formula such as 1/n (n is integer) of the moving speed of the container 100 or the rewritable label 101. With this, it is possible to reduce arithmetic processing load and set the scanning speed of the laser beam L easily.

If a signal of the moving speed of the actually moving container 100 or the rewritable label 101 is input from the erasing operation control unit 77, the scan speed setting unit 76 may carry out a correction based on the moving speed in actual moving and may set the scanning speed again. However, a function of performing this is not always necessary, but may be provided if desired.

The erasing operation control unit 77 is a unit that processes an input signal input into the terminal block 71 and controls the erasing condition setting unit 73, and gives instructions to the laser control unit 78 and the galvano control unit 79, and generates an output signal from the terminal block 71. Furthermore, the erasing operation control unit 77 outputs the signal to the erasing condition setting unit 73 to provide information, with respect to the item where the erasing condition setting unit 73 performs correction and resetting such as the moving speed of the container 100 or the rewritable label 101, among the signals input from the terminal block 71. This makes it possible to carry out necessary correction. Here, this correction may be performed by the erasing operation control unit 77 by referring to the information set in the erasing condition setting unit 73. Such a processing procedure can be set variously according to intended use.

The laser control unit 78 controls the drive of the laser light source 40. Specifically, the laser control unit 78 converts a laser output value that the erasing operation control unit 77 has instructed into an analog signal, and outputs the analog signal to the laser driver 46. In addition, the laser control unit 78 generates a timing signal to turn on/off the laser light source 40 and output the timing signal.

The galvano control unit 79 controls the drive of the galvano mirror 50. Specifically, the galvano control unit 79 generates an analog signal to move the galvano mirror 50 at a specified speed from the scan start position to the scan end position that the erasing operation control unit 77 has instructed.

Figure 3A:
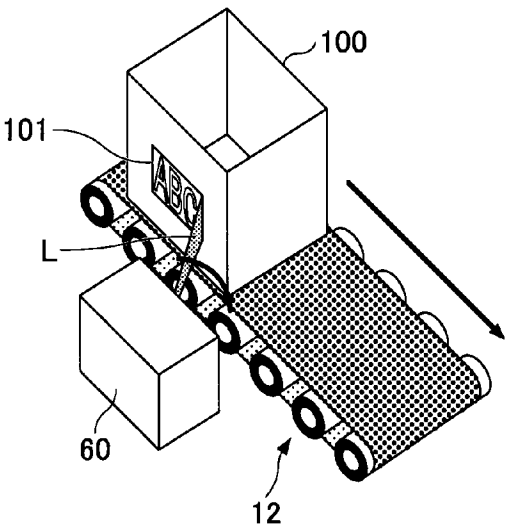
FIG. 3A is an illustration diagram showing an example of an erasing operation of the erasing apparatus of the present embodiment at an erasing starting point.
Figure 3B:
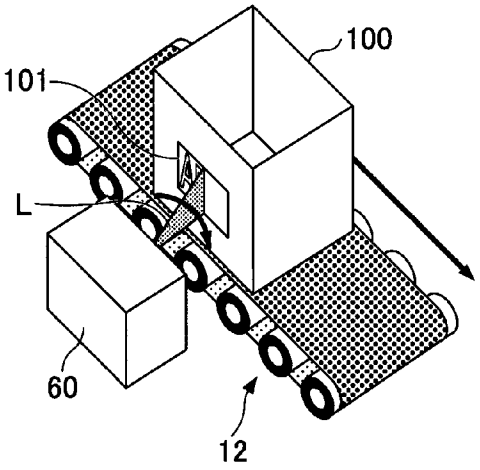
FIG. 3B is an illustration diagram showing an example of the erasing operation of the erasing apparatus of the present embodiment at an erasing middle point.
Figure 3C:
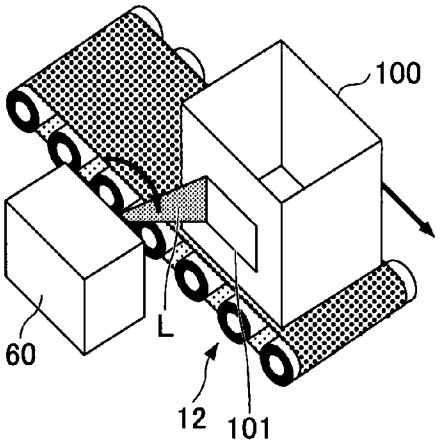
FIG. 3C is an illustration diagram showing an example of the erasing operation of the erasing apparatus of the present embodiment at an erasing end point.

Next, by using FIGS. 3A through 3C, a description is given about an example of an erasing operation of the laser erasing apparatus having such a configuration. FIGS. 3A through 3C are diagrams to describe the erasing operation of the laser erasing apparatus of the present embodiment. Here, the same numerals are used for components similar to those described hereinbefore, and the descriptions are omitted.

FIG. 3A is a diagram showing an example of an erasing operation at the erasing start point. As shown in FIG. 3A, before the rewritable label 101 of the container 100 reaches the front of the laser erasing unit 60, the laser erasing unit 60 emits the laser beam L from the anterior portion of the rewritable label 101. The laser beam L is emitted from the laser erasing unit 60 backward. After that, the laser beam L starts a deflection for scanning in a same direction as a moving direction of the rewritable label 101. Then, the scanning speed is slower than the moving speed of the rewritable label 101. That means that the laser beam L moves forward as well as the rewritable label 101, but because the scanning speed is slower than the moving speed of the rewritable label 101, the laser beam L moves relatively backward, and sweeps the rewritable label 101 slowly backward.

FIG. 3B is a diagram showing an example of an erasing operation at the middle point. As shown in FIG. 3B, when the rewritable label 101 reaches the approximately front of the laser erasing unit 60, the display information on the rewritable label 101 is erased up to about a half. In addition, the laser beam L is emitted from the laser erasing unit 60 approximately toward the front. As shown in FIG. 3A, because the scanning start is from a position still more backward than that of the laser erasing unit 60, it is found that the laser unit 60 irradiates the rewritable label 101 with the laser beam L by using a longer length than the half width of the rewritable label 101 in order to erase the display information with the half width of the rewritable label 101. In other words, the laser erasing unit 60 irradiates the rewritable label 101 with the laser beam L by taking a time.

FIG. 3C is a diagram showing an example of an erasing operation of at the erasing end point. In the erasing end point, the rewritable label 101 advances more forward than the laser erasing unit 60, and the laser erasing unit 60 irradiates the rear edge of the rewritable label 101 with the laser beam L. The laser beam L is emitted from the laser erasing unit 60 forward. The information displayed on the rewritable label 101 is entirely erased.

As shown in FIG. 3A through FIG. 3C, by deflecting the laser beam L at a slower scanning speed than the moving speed of the rewritable label 101 in the same direction as the moving direction of the rewritable label 101, a scan distance can be extended backward and forward, and a scan time can be lengthened. This makes it possible to provide enough energy for the rewritable label 101, and to erase the display information certainly.

Figure 4A:
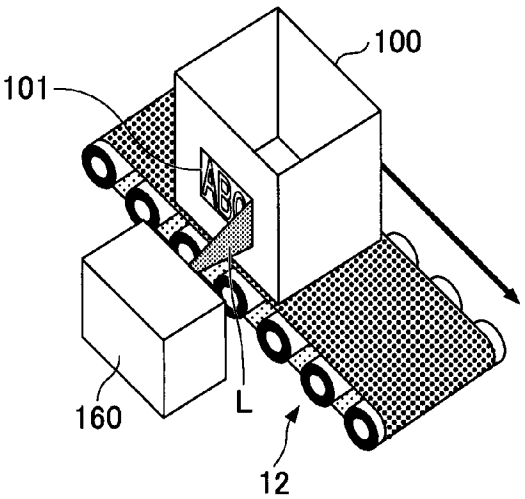
FIG. 4A is a diagram showing an erasing operation of a first conventional laser erasing apparatus at an erasing starting point as a comparative example.
Figure 4B:
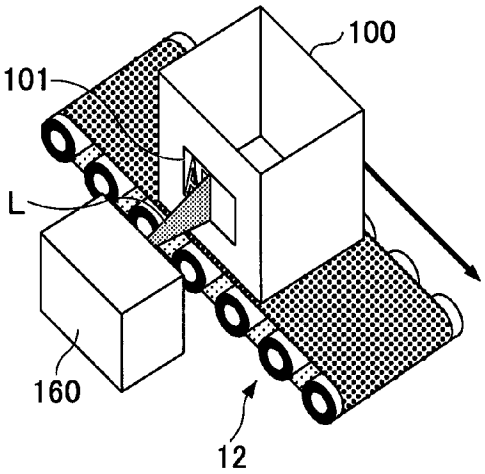
FIG. 4B is a diagram showing the erasing operation of the first conventional laser erasing apparatus at an erasing middle point as a comparative example.
Figure 4C:
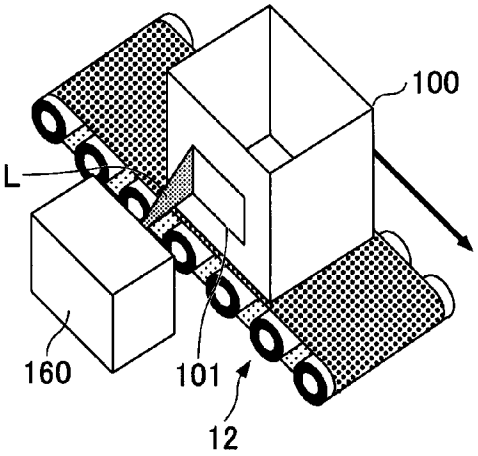
FIG. 4C is a diagram showing the erasing operation of the first conventional laser erasing apparatus at an erasing end point as a comparative example.

FIGS. 4A through 4C are diagrams showing an example of an erasing operation of a first conventional laser erasing apparatus as a comparative example. The first conventional laser erasing apparatus 160 performs the erasure by fixing the laser beam L and by moving the belt conveyor 12 so that the irradiation spot onto the rewritable label 101 with the laser beam L moves. Here, the same numerals are put to components similar to those described hereinbefore, and the description is omitted.

FIG. 4A is a diagram showing an erasing operation at the erasing start point. In the erasing start point, when the forward edge of the rewritable label 101 reaches the front of the laser erasing unit 60, erasing starts.

FIG. 4B is a diagram showing an erasing operation at the middle point. In the erasing middle point, the laser beam L is fixed, and the center of the rewritable label 101 comes to the front of the laser erasing unit 60.

FIG. 4C is a diagram showing an erasing operation at the erasing end point. In the erasing end point, the rear edge of the rewritable label 101 is located in front of the laser erasing unit 60.

In this manner, in the first conventional laser erasing unit 160, the scan distance has only the same width as that of the rewritable label 101. If the laser erasing unit 160 tries to provide enough energy for the rewritable label 101, the belt conveyor 12 is needed to be moved at a considerably slow moving speed, which causes increase of a takt time.

Figure 5A:
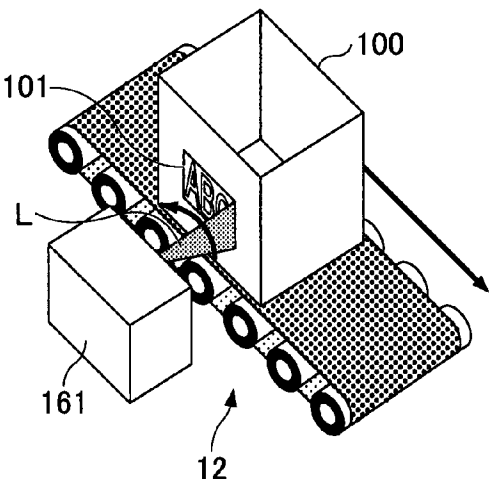
FIG. 5A is a diagram showing an erasing operation of a second conventional laser erasing apparatus at an erasing starting point as a comparative example.
Figure 5B:
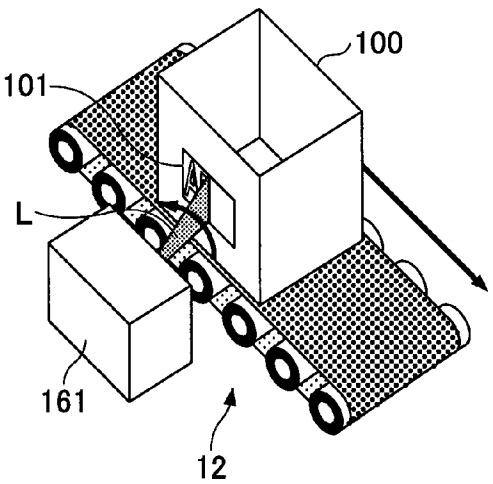
FIG. 5B is a diagram showing the erasing operation of the second conventional laser erasing apparatus at an erasing middle point as a comparative example.
Figure 5C:
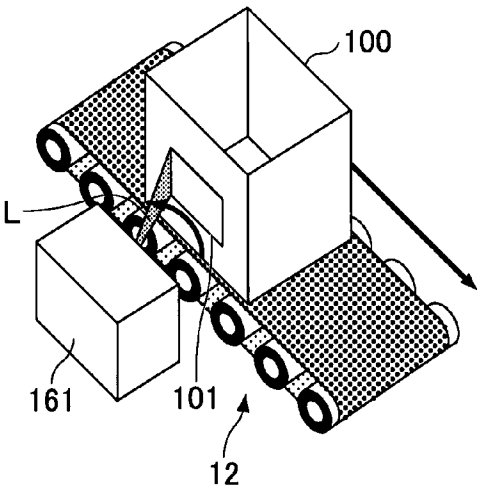
FIG. 5C is a diagram showing the erasing operation of the second conventional laser erasing apparatus at an erasing end point as a comparative example.

FIGS. 5A through 5C are diagrams showing an example of an erasing operation by a second conventional laser erasing apparatus as a comparative example. The second conventional laser erasing apparatus 161 carries out the erasure of the display information by stopping the rewritable label 101 and by deflecting the laser beam L. Here, the same numerals are used for components similar to those described hereinbefore, and the description is omitted.

FIG. 5A is a diagram showing an erasing operation at the erasing start point. In the erasing start point, the rewritable label 101 stops when located in front of the laser erasing apparatus 161. Then, the laser beam L is emitted onto the forward edge of the rewritable label 101. After that, the laser beam L deflects and moves backward, and the rewritable label 101 is scanned.

FIG. 5B is a diagram showing an erasing operation at the erasing middle point. In the erasing middle point, the laser beam L moves backward, and the rewritable label 101 is scanned until the center.

FIG. 5C is a diagram showing an erasing operation at the erasing end point. In the erasing end point, the laser beam L moves up to the rear edge of the rewritable label 101, scanning of the rewritable label 101 is finished.

In this way, in the second conventional laser erasing apparatus 161, the scan distance by the laser beam L has only the same length as the width of the rewritable label 101. Moreover, when the second conventional laser erasing apparatus 161 performs the erasing operation, since the belt conveyor 12 is needed to be stopped, the takt time becomes longer.

As described in FIG. 3A through FIG. 5C, because the laser erasing apparatus 80 of the present embodiment can make the scan distance and the scan time longer than the conventional laser erasing apparatuses 160, 161, and can erase the display information, keeping the belt conveyor 12 moving, it is found that the takt time considerably improves.

Figure 6:
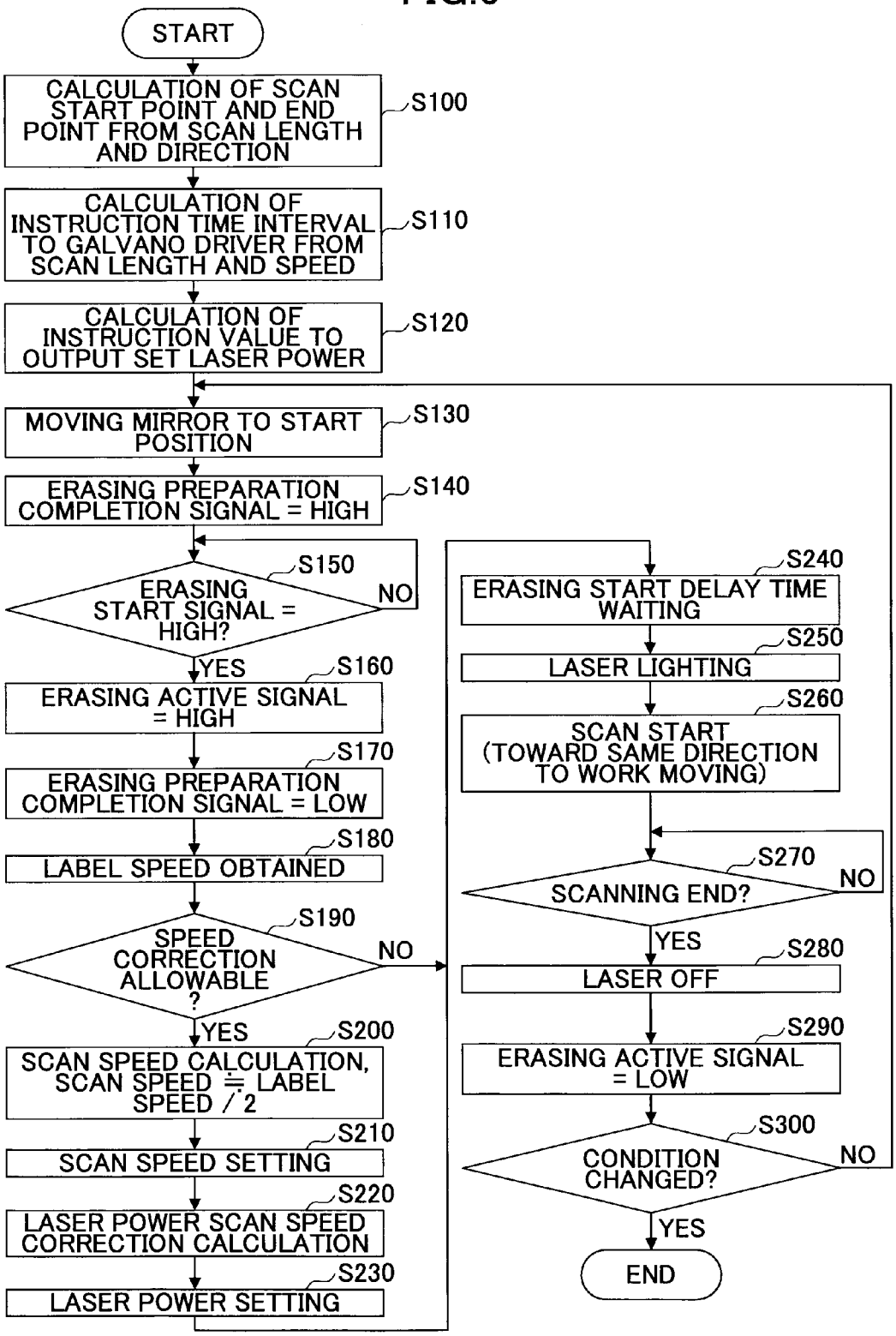
FIG. 6 is a diagram showing an operational flow of a laser erasing method using the laser erasing apparatus of the present embodiment.

FIG. 6 is a diagram showing a processing flow of a laser erasing method using the laser erasing apparatus of the present embodiment. Here, FIG. 6 shows a processing flow in a case of performing a speed correction. Also, the same numerals are put to components similar to those described hereinbefore, and the description is omitted.

First, at the start, a scan distance, a scan direction, a scan speed and a laser output power are set by a user, and are stored in the volatile memory 74 in the erasing condition setting unit 73.

In step S100, the erasing operation control unit 77 calculates a start position and an end position of scanning, from the scan distance and the scan direction set and stored in the erasing operation control unit 73, and provides the start position and the end position for the galvano control unit 79. This means a cycle that the galvano control unit 79 updates the instruction values for the galvano driver 53.

In step S110, the erasing operation control unit 77 calculates a time interval to move the laser beam L only a predetermined length in a short cycle, from the scan distance and scan direction stored in the erasing condition setting unit 73.

In step S120, the erasing operation control unit 77 converts the laser output power set and stored in the erasing condition setting unit 73 into a current value, and provide the current value for the galvano control unit 79.

In step S130, the erasing operation control unit 77 issues an instruction to the galvano control unit 79, and makes the mirror 52 of the galvano mirror 50 move to the scanning start position.

In step S140, an erasing preparation completion signal is turned into "High".

In step S150, the erasing start signal's transition into "High" is awaited. Step S150 is repeated by the time the erasing start signal turns into "High". If the erasing start signal turns into "High", the flow advances to step S160.

In step S160, an erasing active signal is turned into "High", and erasing is started. Moreover, on this occasion, the erasing preparation completion signal is turned into "Low", as shown in step S170.

In step S180, a moving speed of the rewritable label 101 is obtained by using a unit to detect the moving speed of the rewritable label 101 such as an encoder 15.

In step S190, it is determined whether a moving speed correction is allowed or not based on the obtained moving speed of the rewritable label 101. Whether the moving speed correction is allowed is determined based on an error magnitude between the obtained moving speed and the set moving speed. More specifically, if the error is small and less than a predetermined value, it is determined that the error correction is not needed, and the error correction is not allowed. On the other hand, if the error is not less than the predetermined value, performing the error correction is allowed. Here, a determination calculation in step S190 may be carried out by the scan speed setting unit 76 in the erasing condition setting unit 73, or by the erasing condition control unit 77.

In step S190, if it is determined that the speed correction is not allowed, the flow advances to step S200.

In step S200, a scan speed is calculated by using the obtained moving speed of the actually moving rewritable label 101. Here, in step S200 in FIG. 6, an example is cited where the scan speed is set at a half of the moving speed of the rewritable label 101. These processing methods may be determined variously according to intended use.

In step S210, the scan speed setting unit 76 sets the scanning speed based on the calculation result in step S190.

In step S220, a correction calculation of the laser power is performed, corresponding to the scanning speed reset by the speed correction. The faster the scanning speed, the shorter the scan distance and an irradiation time to the rewritable label 101 with the same width. Therefore, in order to provide the same energy for the rewritable label 101 with the same width, the laser power is needed to be increased. Such a correction calculation is carried out in step S220.

In step S230, the laser power is set based on the calculation result in step S220.

In step S240, the erasing start is waited for an erasing start delay time. However, the erasing start delay time may be set in zero, and the erasing start delay time may be provided as necessary.

In step S250, the erasing operation control unit 77 makes the galvano control unit 79 start scanning by providing an instruction for the galvano control unit 79, and simultaneously makes the laser control unit 78 turn on the laser light source 40 by providing an instruction for the laser control unit 78.

In step S260, scanning with the laser beam L begins. As described in FIG. 3, scanning is performed at the set speed, in the same direction as the moving direction of the rewritable label 101.

In step S270, it is determined whether scanning is finished or not. The end of scanning is determined when the laser beam L reaches the scanning end position calculated in step S100. The determination may be executed by the galvano control unit 79 that specifically controls the galvano driver 53. If it is determined that scanning is finished, the galvano control unit 79 notifies the erasing operation control unit 77 of the end of scanning, and the flow advances to step S280.

In step S280, the erasing operation control unit 77 makes the laser control unit 78 turn off the laser light source 40 by providing an instruction for the laser control unit 78.

In step S290, the erasing active signal is turned into "Low".

In step S300, it is determined whether there is any condition change such as change of the rewritable label 101 to be erased. If there is a condition change, once the processing flow is finished, and the processing flow is restarted from the beginning. On the other hand, if there is no condition change, the processing flow is restarted from step S130.

Thus, according to the processing flow of the laser erasing method of the present embodiment, it is possible to properly correct the scan speed, and to correct the other items such as the laser power and the like, corresponding to the scan speed correction.

Here, it is determined whether the speed correction is performed or not in step S190, but adopting a processing flow that constantly performs the corrections without providing step S190 is possible.

Moreover, if the unit that detects the moving speed of the rewritable label 101 such as the encoder 15 and the like is not provided, and the speed correction is not carried out, by eliminating steps S180, S190, S220 and S230, and by using the moving speed set at the belt conveyor 12 as the label moving speed in the scan speed calculation in step S200, the laser erasing method of the present embodiment can be practiced in a similar way.

Figure 7:
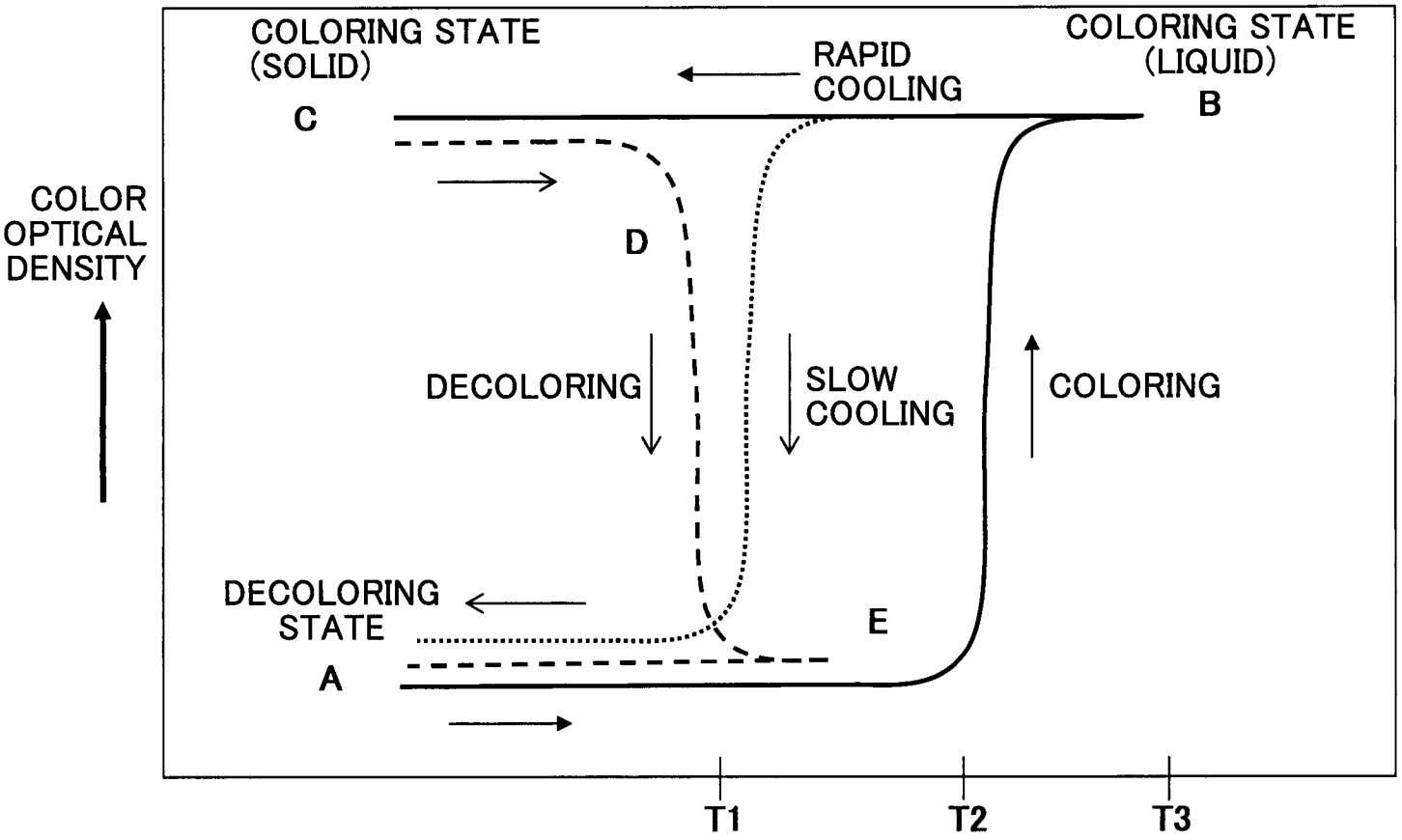
FIG. 7 is an illustration diagram about coloring and decoloring using a reversible thermal recording medium.

FIG. 7 is a diagram for illustrating coloring and decoloring using a reversible thermal recording medium that is used for the rewritable label 101.

The reversible thermal recording medium is a low-molecular-weight organic substance including leuco dye and reversible color developer (which may be called "color developer" hereinafter). The reversible thermal recording medium changes between a state before fusion of the low-molecular-weight organic substance, and a state after the fusion and before crystallization. More specifically, the color tone reversibly changes into a transparent state and a coloring state by heat.

In FIG. 7, if the temperature of a recording layer that is in a decoloring state A at the beginning is raised, the leuco dye and the color developer melt and mix at a melting temperature T2, which causes coloring and enters molten and coloring state B. If the recording layer is rapidly cooled from the molten and coloring state B, the recording layer can be cooled to a room temperature staying the coloring state, and enters a coloring state C where the coloring state is stabilized and solidified. Whether the coloring state C can be obtained depends on a cooling speed. If the recording layer is cooled slowly, decoloring occurs during a cooling process, and the recording layer enters the decoloring state A same as the beginning or a relatively lower density state than the coloring state C by the rapid cooling.

More specifically, if the laser writing device 90 irradiates the reversible thermal recording medium with a laser beam LW, the temperature of the irradiated portion rises, and the irradiated portion goes from the decoloring state A into the molten and coloring state B. The laser beam LW of the laser writing device 90 is a spot-like beam. Because drawing is performed in one stroke, the laser beam LW moves, by which a state where the irradiated portion is cooled rapidly can be caused. Therefore, a transition from the molten and coloring state B into the coloring state C is possible.

Meanwhile, if the temperature of the recording layer is raised from the coloring state C again, decoloring occurs at a lower temperature T1 than the coloring temperature (from D to E). The temperature is cooled from this state, the recording layer returns to the decoloring state A same as the beginning.

The coloring state C obtained by rapid cooling from the molten state is a state where the leuco dye and the color developer are mixed to be able to cause a contact reaction between molecules, and many of the states form a solid state. In this state, a fused mixture of the leuco dye and the color developer (which is the colored mixture as described above) crystallizes and maintains coloring. It is thought that the formation of this structure is stabilizes coloring. On the other hand, decoloring state A is a state where both of the leuco dye and the color developer are phase separated. This state is thought to be a state where molecules of at least one of the compounds assemble to form a domain or crystallize, and where the leuco dye and the color developer separate and become stabilized by cohesion or crystallization. In many cases, thus, both of the leuco dye and the color developer are phase separated and the color developer crystallizes, by which more complete decoloring occurs.

More specifically, if the laser erasing apparatus 80 irradiates the reversible thermal recording medium with the laser beam L, since the temperature of the irradiated portion is raised, the state can move from the coloring state C into the states D, E. Because the laser erasing apparatus 80 irradiates the reversible thermal recording medium with the vertically long linear laser beam L slowly, the temperature is gradually raised, and the state can be moved from the coloring state C through the state D, E and into the decoloring state A.

Here, if the temperature of the recording layer is raised to the temperature T3 not less than the melting temperature T2 repeatedly, poor erasing may occur that cannot achieve erasing even if the recording layer is heated to the erasing temperature. The reason for this seems to be that the color developer is thermally decomposed, becomes difficult to assemble or crystallize, and becomes difficult to separate from the leuco dye. To prevent deterioration of the reversible thermal recording medium by repetition, the difference between the melting temperature T2 and the temperature T3 is reduced when heating the reversible thermal recording medium, by which the deterioration of the medium by repetition can be prevented.

According to the laser erasing apparatus 80 and the laser erasing method of the present embodiment, because the reversible thermal recording medium is irradiated by the laser in enough time, and enough energy can be provided for the reversible thermal recording medium, sufficient erasing effect can be obtained.

According to a laser erasing apparatus of one embodiment, erasing time can be long, and erasing display information of a reversible thermal recording medium can be achieved without stopping conveyance.

According to a laser erasing apparatus of one embodiment, a substantial scan length can be longer than a width of the reversible thermal recording medium, and a sufficient laser dose can be ensured.

According to a laser erasing apparatus of one embodiment, setting a scanning speed of the laser beam can be performed readily, so that corresponding to various erasing conditions is possible.

According to a laser erasing apparatus of one embodiment, if a moving speed of the reversible thermal recording medium subtly changes, an appropriate scan speed by the laser beam can be set.

According to a laser erasing apparatus of one embodiment, if the scanning speed is set fast, irradiated accumulated energy can be constant by raising a laser power of the laser beam, and the energy provided for the reversible thermal recording medium can be made constant even if the scanning speed changes, and the display information can be erased in proper conditions constantly.

Thus, according to a laser erasing apparatus of the embodiments of the present invention, a takt time can be shortened when the display information on the reversible thermal recording medium is erased by using the laser beam.

The embodiments of the present invention can be applied to a laser erasing apparatus that erases display information on a label attached to a shipping container and the like.

The present invention is not limited to these embodiments, but variations and modifications may be made without departing from the scope of the present invention.

The present application is based on Japanese Priority Patent Application No. 2010-203707, filed on Sep. 10, 2010, the entire contents of which are incorporated herein by reference.

The invention claimed is:

1. A laser erasing apparatus, comprising:

a conveyor that moves a reversible thermal recording medium at a predetermined moving speed and in a moving direction, the reversible thermal recording medium having display information thereon and the reversible thermal recording medium reversibly changing a color tone according to a temperature of the reversible thermal recording medium; and a laser erasing circuit configured to erase the display information by controlling a light source to irradiate the reversible thermal recording medium with a laser beam while the conveyor moves the reversible thermal recording medium and to deflect the laser beam in the moving direction at a predetermined scanning speed that is slower than the predetermined moving speed.

2. The laser erasing apparatus as claimed in claim 1, wherein a width of the laser beam is longer than a width of the reversible thermal recording medium, and the width of the laser beam is oriented in a direction perpendicular to the moving direction.

3. The laser erasing apparatus as claimed in claim 2, wherein the laser erasing circuit includes a deflector configured to deflect the laser beam and a driver configured to drive the deflector, and the laser erasing circuit is configured to set the predetermined scanning speed based on the predetermined speed of the reversible thermal recording medium.

4. The laser erasing apparatus as claimed in claim 3, further comprising:

a moving speed detector configured to detect the moving speed of the reversible thermal recording medium, wherein the laser erasing circuit is configured to correct the predetermined scanning speed based on the detected moving speed.

5. A laser erasing apparatus as claimed in claim 4, further comprising:

a laser power setting circuit configured to set a laser power of the laser beam based on the corrected predetermined scanning speed.

6. The laser erasing apparatus as claimed in claim 1, further comprising:

a deflector configured to deflect the laser beam; and a driver configured to drive the deflector, wherein the laser erasing circuit is configured to set the predetermined scanning speed based on the predetermined moving speed of the reversible thermal recording medium.

7. The laser erasing apparatus as claimed in claim 6, further comprising:

a moving speed detector configured to detect the moving speed of the reversible thermal recording medium, wherein the laser erasing circuit is configured to correct the predetermined scanning speed based on the moving speed detected by the moving speed detector.

8. The laser erasing apparatus as claimed in claim 7, further comprising:

a laser power setting circuit configured to set a laser power of the laser beam based on the corrected predetermined scanning speed.

9. The laser erasing apparatus as claimed in claim 1, wherein the display information is provided on the reversible thermal recording medium when the reversible thermal recording medium is a first temperature, and the display information is removed from the reversible thermal recording medium when the reversible thermal recording medium is irradiated to be a second temperature.

10. A laser erasing method, comprising:

moving a reversible thermal recording medium at a predetermined speed and in a moving direction, the reversible thermal recording medium having display information thereon and the reversible thermal recording medium reversibly changing a color tone according to a temperature of the reversible thermal recording medium; and erasing, by a laser erasing circuit, the display information by controlling a light source to irradiate the reversible thermal recording medium with a laser beam while the reversible thermal recording medium moves and to deflect the laser beam in the moving direction at a predetermined scanning speed that is slower than the predetermined moving speed.

11. The laser beam erasing method as claimed in claim 10, further comprising:

setting the predetermined scanning speed to be slower than the predetermined moving speed of the reversible thermal recording medium.

12. The laser beam erasing method as claimed in claim 11, wherein width of the laser beam is longer than a width of the reversible thermal recording medium, and the width of the laser beam is oriented in a direction perpendicular to the moving direction.

13. The laser erasing method as claimed in claim 12, further comprising:

detecting a moving speed of the reversible thermal recording medium; and correcting the predetermined scanning speed based on the detected moving speed of the reversible thermal recording medium.

14. The laser erasing method as claimed in claim 13, further comprising:

setting a laser power of the laser beam based on the corrected predetermined scanning speed.

15. The laser beam erasing method as claimed in claim 11, further comprising:

detecting a moving speed of the reversible thermal recording medium; and correcting the predetermined scanning speed by the laser beam based on the detected moving speed of the reversible thermal recording medium.

16. The laser erasing method as claimed in claim 15, further comprising:

setting a laser power of the laser beam based on the corrected predetermined scanning speed.

17. An erasing device, comprising:

processing circuitry configured to control a light source to irradiate a reversible thermal recording medium with a laser beam while the reversible thermal recording medium moves in a moving direction at a predetermined speed, and control the light source to deflect the laser beam in the moving direction at a predetermined scanning speed that is slower than the predetermined moving speed, wherein display information is provided on the reversible thermal recording medium and the reversible thermal recording medium reversibly changes a color tone according to a temperature of the reversible thermal recording medium.

18. The erasing device as claimed claim 17, wherein a width of the laser beam is longer than a width of the reversible thermal recording medium, and the width of the laser beam is oriented in a direction perpendicular to the moving direction.

19. The erasing device as claimed in claim 17, further comprising:

a deflector; and a driver, wherein the processing circuitry is configured to control the deflector to deflect the laser beam, control the driver to drive the deflector, and set the predetermined scanning speed based on the predetermined moving speed of the reversible thermal recording medium.

20. The erasing device as claimed in claim 19, wherein a detector detects the moving speed of the reversible thermal recording medium, and the processing circuitry is configured to correct the predetermined scanning speed based on the moving speed detected by the detector.

* * * * *